US005461288A

United States Patent [19]

Chaves et al.

[11] Patent Number: 5,461,288

[45] Date of Patent: Oct. 24, 1995

[54] POWER MANAGEMENT DEVICE FOR LARGE ELECTRONIC FLASH UNITS

[76] Inventors: Neal Chaves, 21 Moody Pt. Dr., Newmarket, N.H. 03857; David Mendelsohn, 15 Tall Pines Rd., Durham, N.H. 03824; Philip J. Doucet, 48 Cutler Rd., Andover, Mass. 01810

[21] Appl. No.: 9,913

[22] Filed: Jan. 27, 1993

[51] Int. Cl.[6] ..... H05B 41/36

[52] U.S. Cl. ..... 315/241 P; 315/241 S; 315/200 A; 354/145.1; 354/132; 354/147; 307/38; 307/39; 307/41

[58] Field of Search ..... 315/241 S, 241 P, 315/325, 312, 315, 316, 324, 318, 319, 200 A; 354/145.1, 132, 147; 307/11, 38, 39, 41

[56] References Cited

U.S. PATENT DOCUMENTS 4,623,824 11/1986 Scolari et al. ..... 315/241 R

FOREIGN PATENT DOCUMENTS 2061535 5/1981 United Kingdom ..... 354/145

94015251 7/1994 WIPO ..... 354/145.1

*Primary Examiner*—Robert J. Pascal

*Assistant Examiner*—Arnold Kinkead

[57] ABSTRACT

A device for controlling the surge of electrical current demanded following the discharge of a lighting system comprised of multiple electronic flash units powered from a common source. Individual electronic flash units are recharged sequentially by the invention after system discharge, thus limiting the current demand to approximately the level produced by a single strobe light apparatus. The power management device for large electronic flash units can be integrated into the circuits of a strobe light apparatus, a generator, inverter or battery pack itself, or it can be configured as a self-contained accessory device.

4 Claims, 5 Drawing Sheets

POWER MANAGEMENT DEVICE FOR LARGE ELECTRONIC FLASH UNITS

BACKGROUND

The inventors Neal Chaves and David Mendelsohn, each have more than fifteen years of professional photography experience. The third inventor, Philip Doucette, is an electrical engineer skilled in electronic circuit design. Our work has often taken us to remote locations where lighting equipment, primarily electronic flash, is powered from long extension cords, or from generators, inverters, or batteries. In many of these situations, where the light from three or four large electronic flash units would be very desirable, the current capacity of the electrical source permits the use of only one.

Commercial photographers frequently employ the largest and most powerful of these electronic flash "power packs". These units demand high levels of electrical current (in excess of 90 AMPS) in a surge while re-charging after the flash, and then "idle" or "float" at a much lower level (1 to 2 AMPS) until discharged again. Re-cycle time for large units ranges between one and six seconds. A few designs have internal circuits to slow down the re-cycle rate of the individual unit, but still produce significant current surges, and these existing circuits do not achieve or fulfill the purpose of the present invention. The characteristic pattern of power consumption produced by large electronic flash units usually dictates that no more than one such unit may be connected to a single 15 or 20 AMP service main, or blown fuses and tripped circuit breakers will result.

In response to this limitation imposed upon our needs and the needs of other photographers, we conceived and reduced to practice the power management circuit for large electronic flash units which is the basis of the stand-alone accessory device we call THE MAGIC BUS. To the best of our knowledge, based on our years of experience in the fields of photography and lighting, and on our continuing review of all relevant professional journals, no similar device for use with electronic flash systems has been produced or proposed by other inventors.

THE OBJECT OF THE INVENTION

The object of the power management device for large electronic flash systems (MAGIC BUS) is to enable electronic flash users to power more of these units from any single power source than would otherwise be possible. This results in proportionately more light output from the lighting system. More light output from a given power source is the ultimate goal of the invention. In order to attain this goal, the re-charging time of the entire system will necessarily increase. The invention also has an application in motion picture and video lighting. The filament-type continuous bulbs used by film makers have a current demand pattern similar to electronic flash. As an added benefit, the invention may also reduce utility costs in studios and other commercial locations where electronic flash is used and where demand is metered separately.

SUMMARY OF THE INVENTION

The invention of the power management device for large electronic flash units now permits four of these units to be easily powered by a single 15 AMP supply. The name "MAGIC BUS" is derived from the way the power management circuit makes power available for electronic flash charging through four points on the same bus bar which become energized sequentially.

The power management device for large electronic flash units is connected to a power main, and up to four electronic flash units are powered through it. Discharge of the electronic flash units causes circuits controlling power relays to instantly shed all but one of the electronic flash units from the power line.

The invention may be synchronized with the camera and lighting system by one of several methods. The synchronizing signal from the camera shutter can be relayed through the invention (where it is detected) to the electronic flash units. The invention may also be fitted with "slave" receivers, which trigger the device upon detection of a flash burst, or of an infrared or radio signal from a transmitter wired to the camera shutter. A "test button" on the invention can simultaneously discharge the electronic flash units and trigger the invention.

After a programmed time delay, during which the first electronic flash has re-charged, the second electronic flash unit is energized. After a second equal delay, during which the second electronic flash is fully charged, the third electronic flash is energized. Following the same pattern, the fourth electronic flash is energized, and when the fourth unit is fully charged, the entire lighting system is ready for another exposure. Three adjustable delay intervals are provided, as is an audible signal which sounds after each delay. The practical limit on the number of electronic flash units that can be thus re-charged depends on a number of factors concerning the design of the particular flash units and is, no doubt, greater than four.

The power management device for large electronic flash units will also expand the capabilities of generators, inverters and batteries used to power electronic flash units strobe units in the same way that it functions off the mains.

Although it was invented in response to the needs of location photographers using electronic flash, the power management device for large electronic flash units can also expand the utility continuous filament-type lighting systems used for film and video and of electronic flash systems used for navigation, entertainment and advertising.

DESCRIPTION OF PREFERRED EMBODIMENTS

Figure 1A:
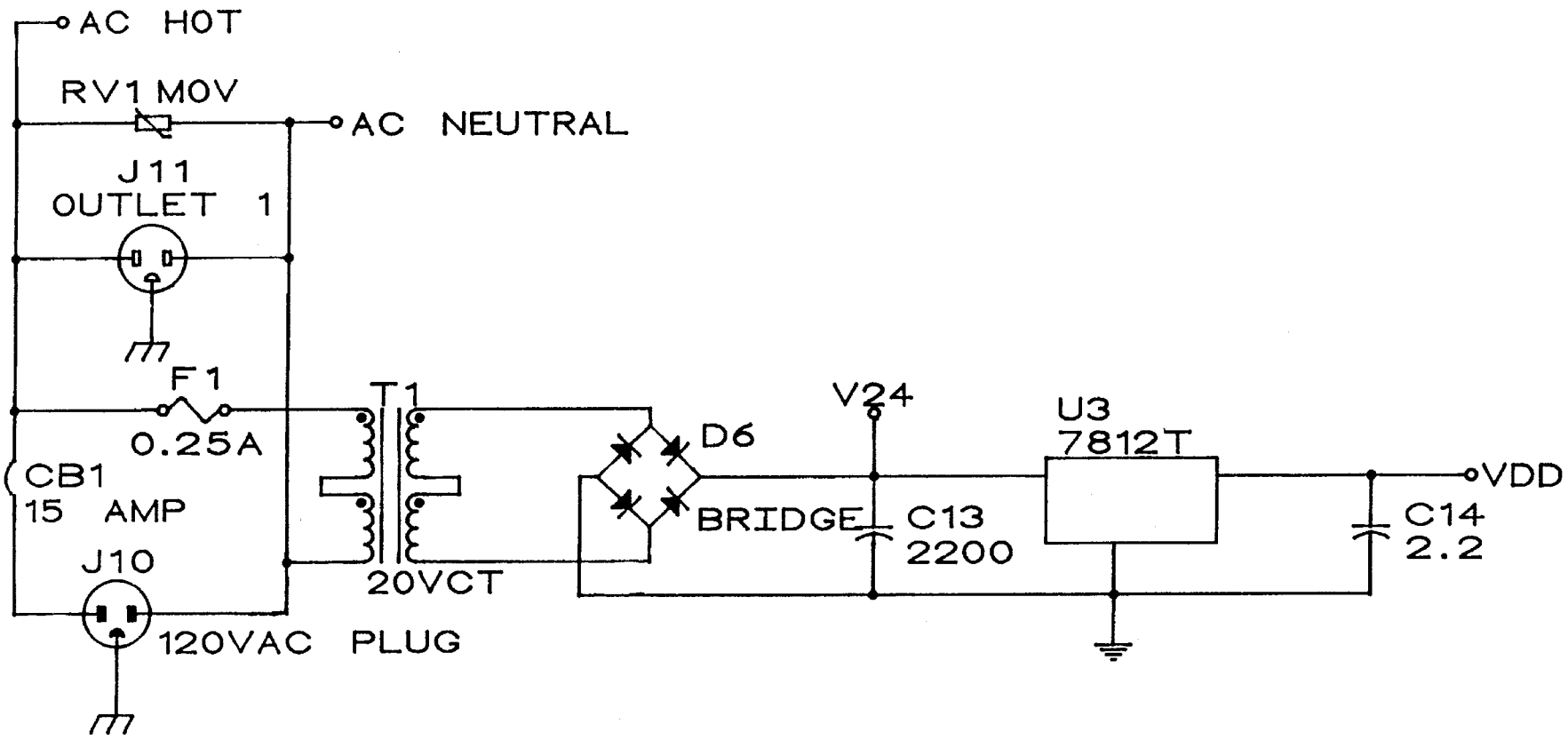
FIG. 1A–D is a schematic diagram of the most preferred embodiment of the present invention. Shown is a self-contained accessory device for large electronic flash units called the "MAGIC BUS" by the inventors.

Before proceeding with a detailed description of the preferred embodiment of the present invention, it should be noted that many thousands of electronic flash units are currently in use. In order to accommodate these existing units, a self-contained accessory for them containing the power management circuitry for large electronic flash units of the present invention is immediately required. Some or all of this circuitry, however, might also be incorporated into electronic flash units, generators, inverters or battery packs themselves.

Referring now to the drawings, there is illustrated the most preferred embodiment of the device as it is compatible with most large electronic flash units presently in use. In this case the power source is an AC main, generator or inverter, and the electronic flash units are the AC powered type.

Referring now specifically to FIG. 1A, AC power into the invention is supplied from the mains through a 15A circuit breaker and main power switch and is wired directly to service outlet No. 1. A DC power supply for the essential circuitry in the device is also connected at this point.

Figure 1B:
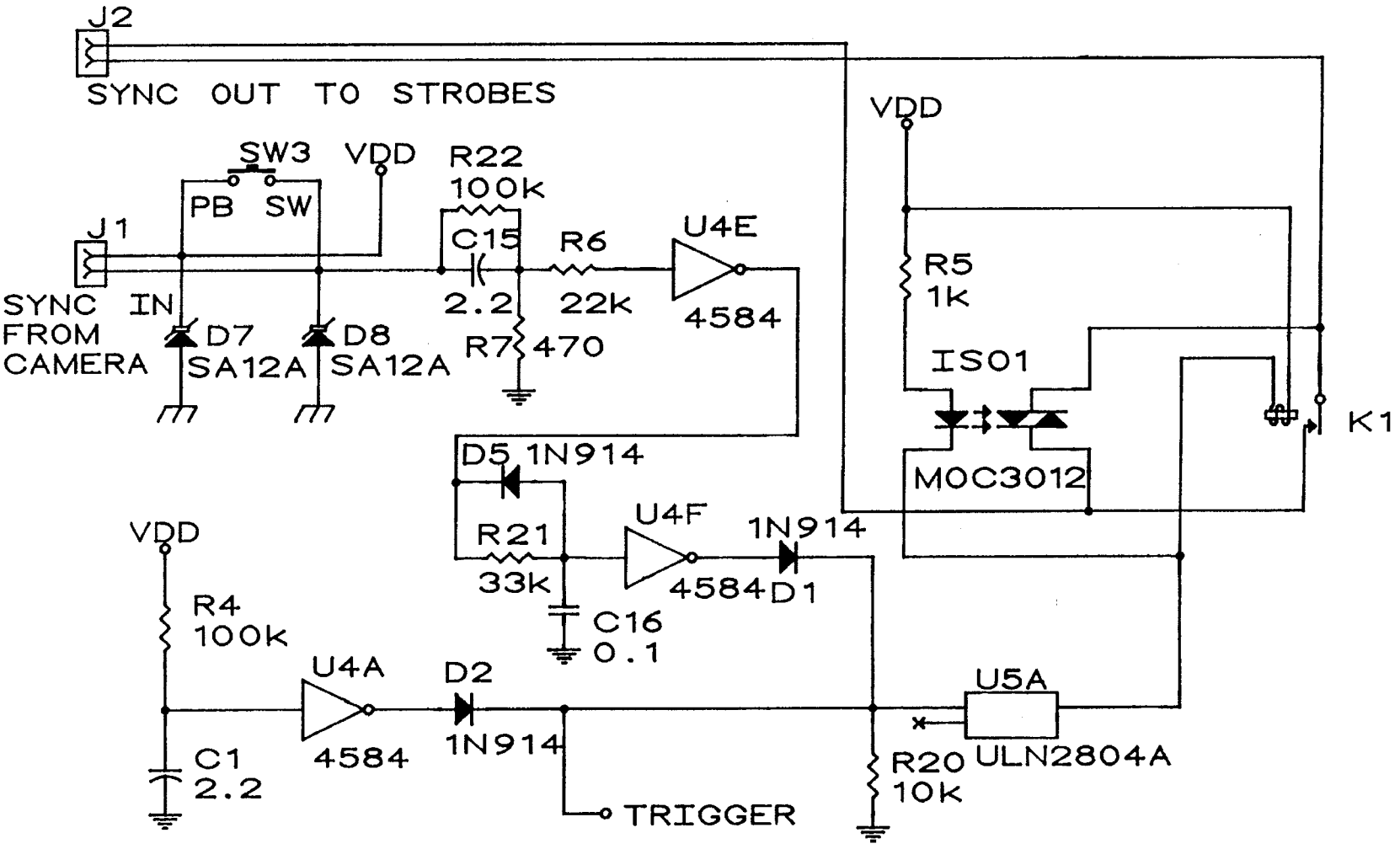

Referring now to FIG. 1B, A dry contact synchronizing pulse from a camera, slave device or push button SW3, via connector J1, is high-pass filtered by C15/R7 (1 ms time constant), with R7 selected to provide a 25 mA initial "contact cleaning" current. R22 discharges C15 between synchronizing pulses, assumed to about 1 second minimum. R6 provides current limiting protection for the input to Schmitt trigger inverter circuit U4E in case of accidental application of high voltages to J1. Pulse stretching circuit C16/R21/D5 (3.3 ms time constant) removes any contact bounce noise, and determines the minimum length of the "To Strobe" output pulse. Output at U4F is the final signal to the timing logic.

R4/C1 are used to reset the timing logic upon initial application of power to the circuit. D1 and D2 diodes "OR" the power-up reset and trigger signals.

Opto-isolator ISO1 and relay K1 transfer the synchronizing pulse to the J2 electronic flash sync cord receptacle. The isolator and relay are in parallel, with ISO1 providing fast response (tens of microseconds), and K1, a fast reed relay, eventually operating to turn off the triac output of ISO1. The fast response of the isolator is necessary so that unacceptable delays are not introduced in the delivery of the synchronizing signal, which could cause the electronic flash units to discharge out of sync with the open camera shutter.

Figure 1C:
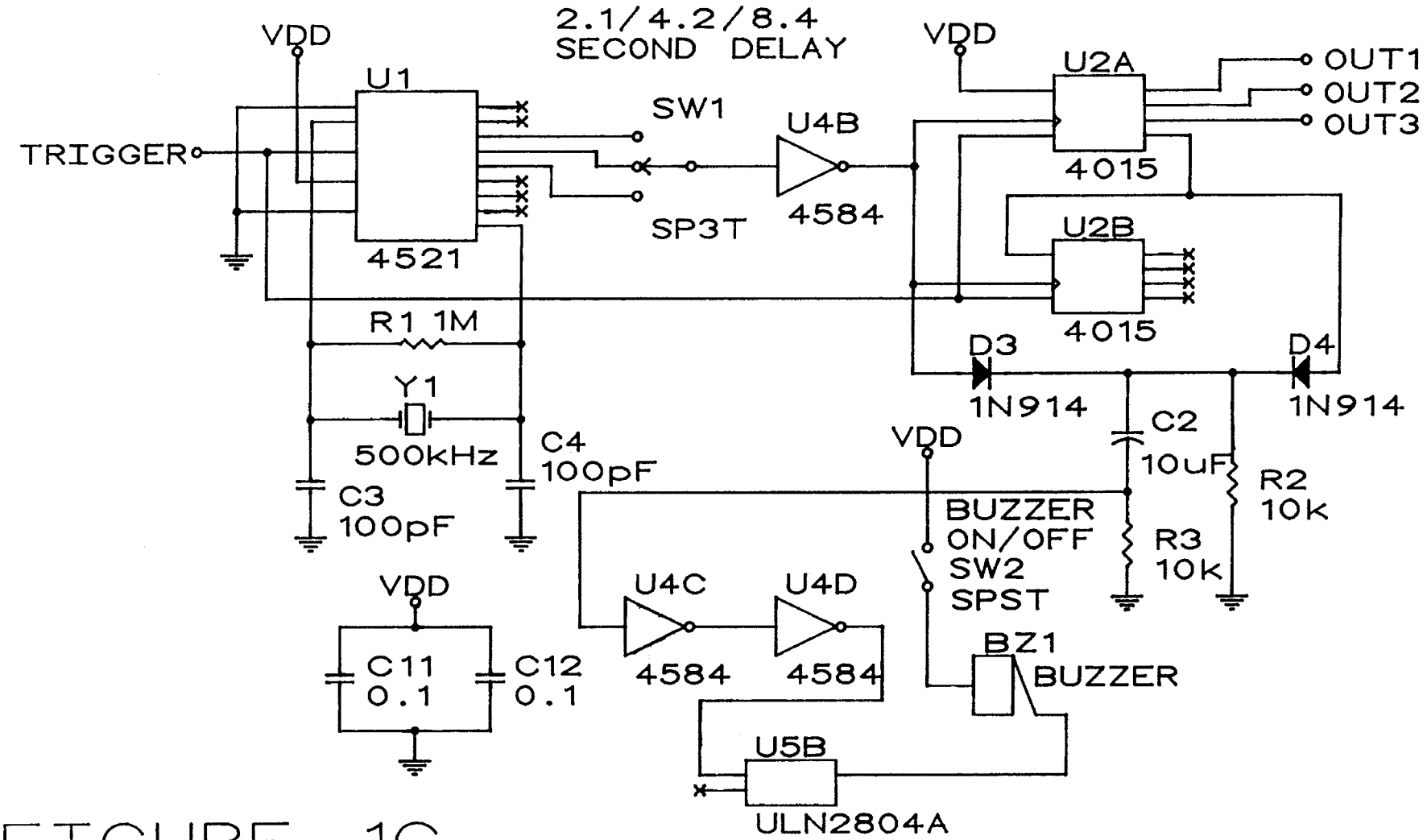

Referring now to FIG. 1C, U1 and U2 form the heart of the timing circuit. U1 is a frequency divider driven by a resonator (Y1) controlled oscillator. One of three taps from the divider is selected by SW1 ("Slow, Med, Fast") and fed to shift register U2. The outputs of U2A activate three power switching circuits in sequence. The selected frequency divider output and final output of register U2A are also used through diodes D3 and D4 to pulse audible buzzer BZ1. Each alarm pulse duration is determined by C2/R3, buffered by Schmitt trigger inverter U4C. Switch SW2 allows turning the buzzer on and off.

Figure 1D:
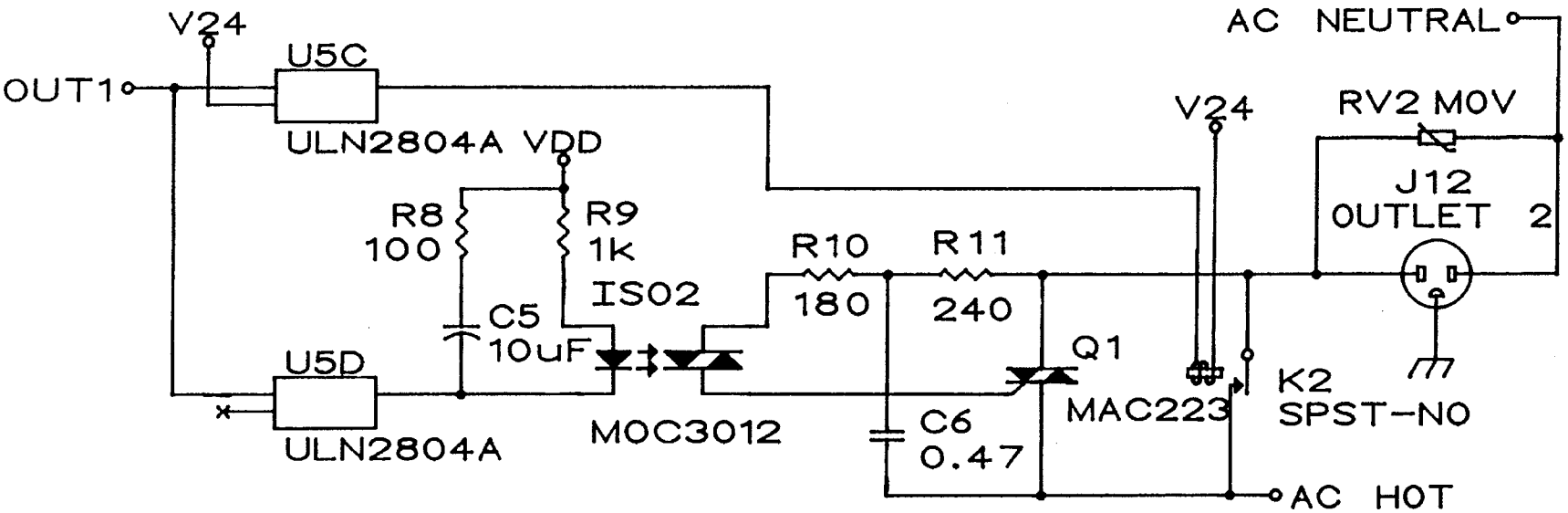
Figure 2:
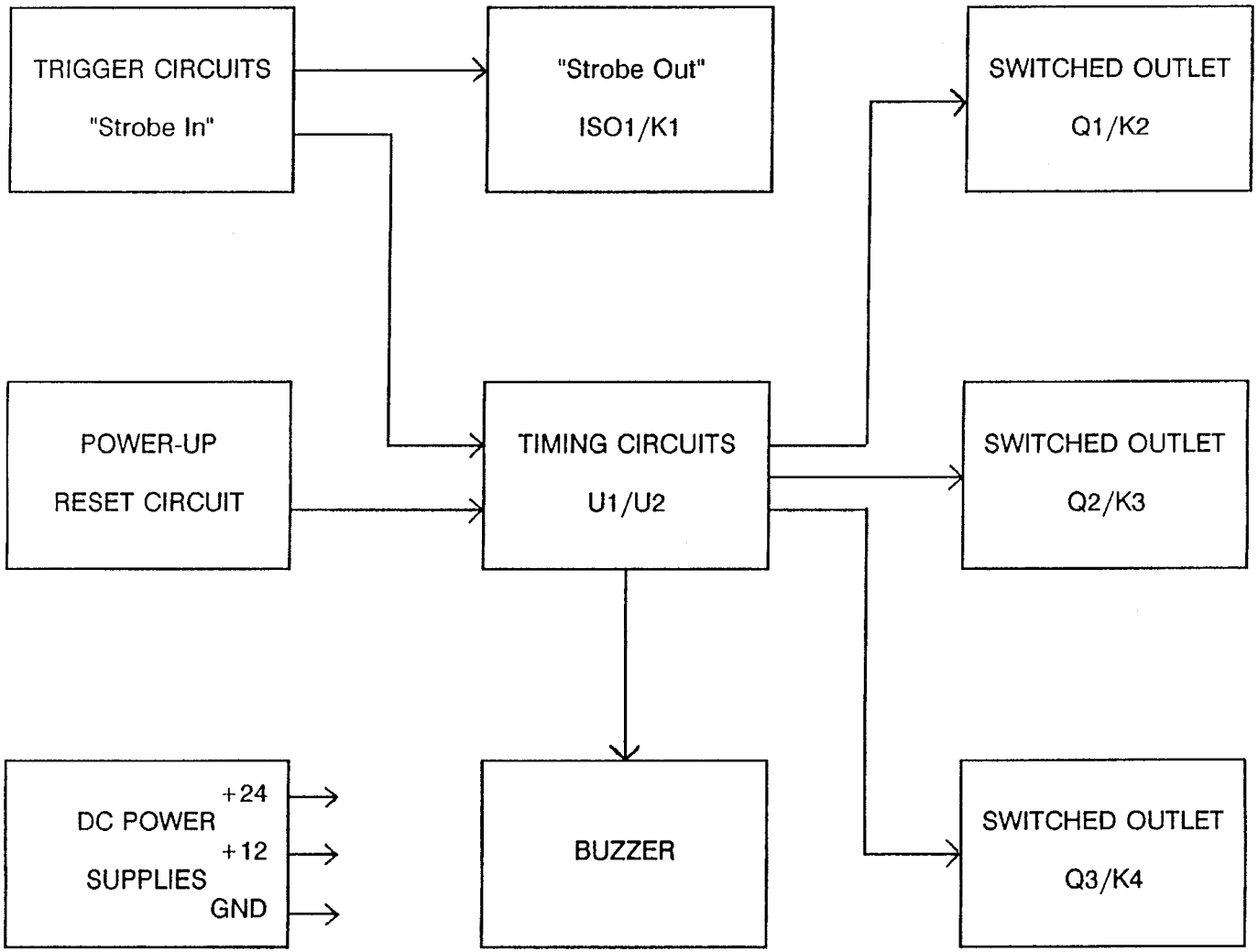
FIG. 2 is a simplified block diagram of the present invention.

Referring now to the block diagram of FIG. 2, there are three identical power switching circuits based on a power triac and relay combined in parallel. Q1/K2, Q2/K3, and Q3/K4 form these circuits. Description of the Q1/K2 pair follows. See FIG. 1D.

Upon receiving an enabling signal from the shift register (U2A), U5C and U5D open collector drivers energize optical isolator ISO2 and relay K2. Capacitor C5 is quickly charged up through R8. The triac output of ISO2 drives power triac Q1, with C6/R11 combination acting as a snubber. The triac provides power to the outlet J12 in less than 100 microseconds, so that only Q1's saturation voltage is seen across the terminals of K2 long before it contacts have closed. This prevents most arcing on contact closure. Outlet J12 is bypassed by MOV transient suppressor RV2 to prevent voltage spikes from adversely affecting Q1.

When it is time to de-energize the circuit, drive signals are removed from the isolator and relay. C5 discharges through R8 and R9 to keep ISO2 energized for approximately an additional 20 ms, allowing K2's contacts to open completely before the triac is de-energized. This prevents most arcing on contact opening, thereby lengthening contact electrical life.

Referring now once again to FIG. 1A, low voltage DC power for the circuits is provided by fused(F1) AC line transformer T1, rectified by bridge D6 and filtered by C13. 24 volts is supplied for relays K2, K3 and K4. Linear regulator U3 steps this voltage down to 12 volts for all other circuitry.

While we have shown and described what we consider to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

We claim:

1. A power management device for managing a single power supply to a plurality of electronic flash units which limits the electrical current demand on an AC main single power supply following a simultaneous discharge of the plurality of electronic flash units, comprising:

a power supply input connecting said power management device to an AC main single power supply;

a synchronization circuit for detecting simultaneous flash discharge of said plurality of electronic flash units;

a plurality of service outlets for providing electrical power to each of the plurality of electronic flash units; and an electronic timing circuit interfaced between said power supply input and said plurality of service outlets, said electronic timing circuit immediately disconnects said plurality of service outlets from said power supply input when said synchronization circuit detects the simultaneous flash discharge and thereafter reconnects said plurality of service outlets to said power supply input in a timed delay sequence, thereby limiting the electrical current demand placed on the AC main single power supply.

2. A power management device as recited in claim 1 wherein said synchronization circuit detects the closure of camera shutter flash synchronization contacts thru a high-pass filter and a Schmitt trigger which simultaneously delivers a trigger pulse to said electronic timing circuit and closes firing circuits of one or more of the plurality of electronic flash units via an opto-isolator/reed relay combination.

3. A power management device as recited in claim 1 wherein said electronic timing circuit comprises a frequency divider driven by a resonator controlled oscillator with one of three switch selectable taps from the frequency divider fed to a shift register, the outputs of which activate three power switching circuits in sequence, said electronic timing circuit further including a reset circuit which starts the timed delay sequence whenever power is first applied to the power management device.

4. A power management device as recited in claim 1 wherein each of said plurality of service outlets comprise a triac output opto-isolator and a mechanical relay energized by a shift register, with the triac output of the opto-isolator driving a power triac in parallel with the mechanical relay.

* * * * *